US008246206B2

(12) United States Patent
Hung et al.

(10) Patent No.: US 8,246,206 B2
(45) Date of Patent: Aug. 21, 2012

(54) LIGHT EMITTING MODULE AND LED LAMP EMPLOYING IT

(75) Inventors: Lung-Yu Hung, Miao-Li Hsien (TW); Sheng-Hsiang Kung, Miao-Li Hsien (TW); Shi-Ying Chang, Miao-Li Hsien (TW); Hsiu-Ping Chang, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 0 days.

(21) Appl. No.: 13/026,277

(22) Filed: Feb. 13, 2011

(65) Prior Publication Data

US 2012/0099316 A1 Apr. 26, 2012

(30) Foreign Application Priority Data

Oct. 25, 2010 (TW) ..... 99136238 A

(51) Int. Cl.
*F21V 21/00* (2006.01)

(52) U.S. Cl. ..... 362/249.11; 362/249.02; 362/294; 362/373

(58) Field of Classification Search ..... 257/79, 257/88, 98–100, E25.02, 719, 720, 722; 349/56–62
See application file for complete search history.

(56) References Cited

U.S. PATENT DOCUMENTS

| | | | | |
|---|---|---|---|---|
| 5,738,531 | A * | 4/1998 | Beaman et al. | 439/71 |
| 7,325,955 | B2 * | 2/2008 | Lucas et al. | 362/545 |
| 7,341,362 | B2 * | 3/2008 | Bjornson et al. | 362/294 |
| 7,344,296 | B2 * | 3/2008 | Matsui et al. | 362/652 |
| 7,540,761 | B2 * | 6/2009 | Weber et al. | 439/487 |
| 7,625,099 | B2 * | 12/2009 | Newton et al. | 362/238 |
| 7,837,362 | B2 * | 11/2010 | Zhang | 362/373 |
| 7,887,218 | B2 * | 2/2011 | Wang | 362/240 |
| 2008/0191231 | A1 * | 8/2008 | Park et al. | 257/98 |
| 2009/0129092 | A1 * | 5/2009 | Chen | 362/294 |

* cited by examiner

*Primary Examiner* — Hargobind S Sawhney
(74) *Attorney, Agent, or Firm* — Altis Law Group, Inc.

(57) ABSTRACT

A light emitting diode lamp includes a lamp rack and a light emitting module mounted on the lamp rack. The ling emitting module includes a printed circuit board and a plurality of LEDs attached to the printed circuit board. The LEDs are arranged in an array. Each of the LEDs has a width W. Each of the LEDs spaces from an adjoining LED with a distance D. The width W and the distance D are in the condition that 0.5>W/D>0.15.

5 Claims, 3 Drawing Sheets

LIGHT EMITTING MODULE AND LED LAMP EMPLOYING IT

BACKGROUND

1. Technical Field

The disclosure relates to an illuminating device and, more particularly, to a light emitting module and an LED (light emitting diode) lamp using the light emitting module.

2. Description of Related Art

The technology of light emitting diodes has rapidly developed in recent years, allowing expansion of application from indication to illumination. With its features of long-term reliability, environmental friendliness and low power consumption, the LED is viewed as a promising alternative for recent lighting products.

A typical LED lamp includes a light emitting module with a number of LEDs put in an array to form a planar light source. Assuming that each of the LEDs is spaced apart an adjoining LED with a distance A, when the distance A is too large, dark regions would be formed on a light-receiving object; when the distance A is too small, a light intensity is too large and a light emitting efficiency of the LED lamp is depressed.

What is needed, therefore, is an LED illumination apparatus to overcome or at least mitigate the above-described problem.

BRIEF DESCRIPTION OF THE DRAWINGS

The components of the drawings are not necessarily drawn to scale, the emphasis instead being placed upon clearly illustrating the principles of the embodiments of the illumination device. Moreover, in the drawings, like reference numerals designate corresponding parts throughout several views.

DETAILED DESCRIPTION

Figure 1:
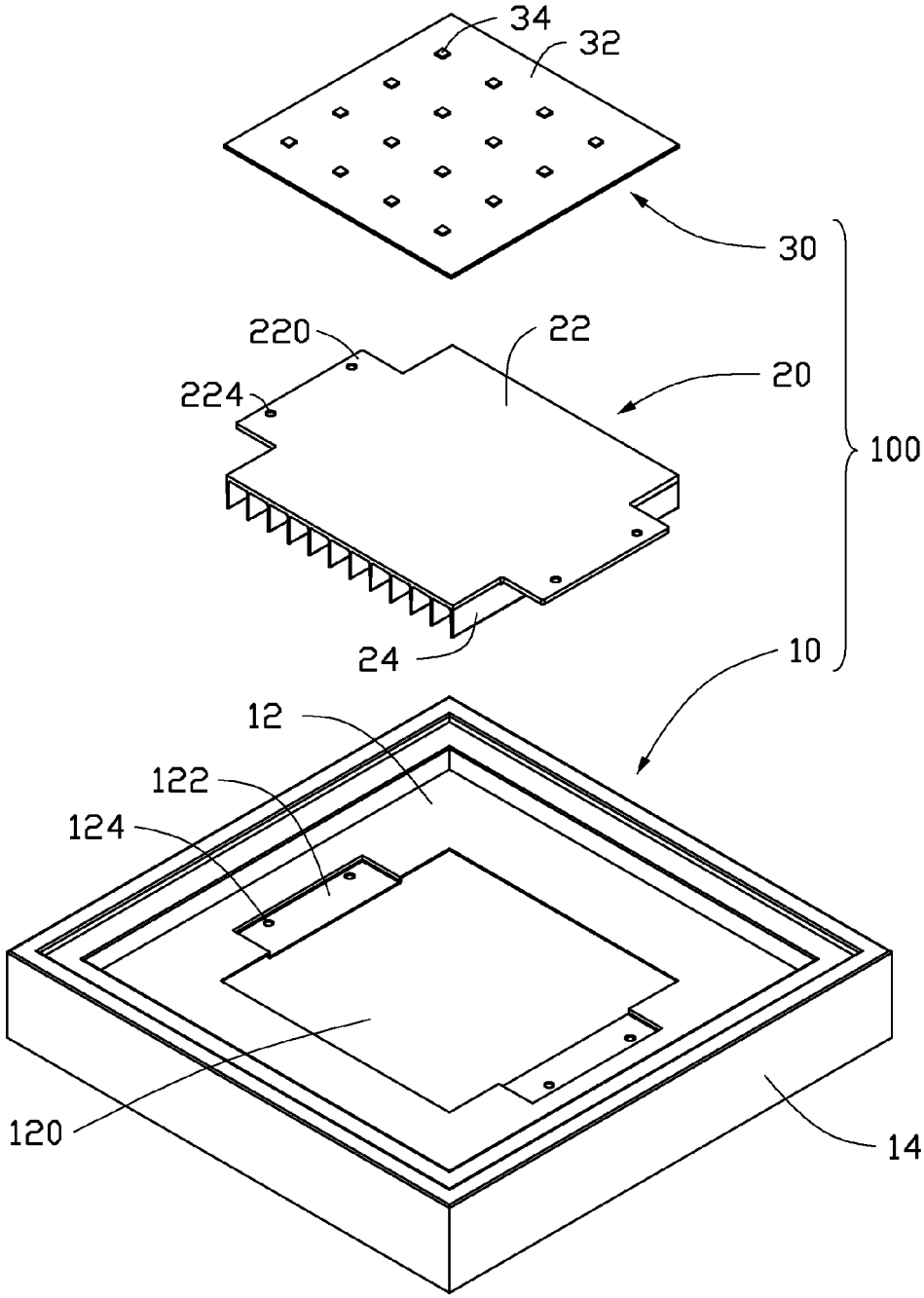
FIG. 1 is an isometric, exploded view of an LED lamp in accordance with an embodiment of the disclosure.

Referring to FIG. 1, an LED lamp 100 is illustrated in accordance with an embodiment of the disclosure. The LED lamp 100 comprises a lamp rack 10, a heat sink 20 mounted on the lamp rack 10, and a light emitting module 30 mounted on the heat sink 20.

The lamp rack 10 has a rectangular profile. The lamp rack 10 comprises a flat inner wall 12 and four sidewalls 14 extending integrally upwards and downwards from outer edges of the inner wall 12. The inner wall 12 is perpendicular to the sidewalls 14. The inner wall 12 defines a rectangular opening 120 in a center thereof. The inner wall 12 forms two spaced, confronting supporting portions 122 at two spaced, confronting sides of the opening 120 thereof. A plurality of through holes 124 are defined in the inner wall 12 at the supporting portions 122 for extension of fasteners (not shown) therethrough.

The heat sink 20 is integrally formed by metallic material having a good thermal conductivity, such as copper, aluminum or an alloy thereof. The heat sink 20 comprises a rectangular, flat base 22 and a plurality of spaced parallel fins 24 extending perpendicularly and downwardly from the base 22. Two protrusions 220 protrude horizontally and outwardly from two opposite sides of the base 22, respectively. The protrusions 220 respectively abut the supporting portions 122 of the inner wall 12 of the lamp rack 10, and the fins 24 extend through the opening 120 of the inner wall 12 of the lamp rack 10 into a lower space of the lamp rack 10. Each of the protrusions 220 defines a pair of through holes 224 corresponding to the through holes 124 of the corresponding supporting portion 122 of the lamp rack 10.

Figure 2:
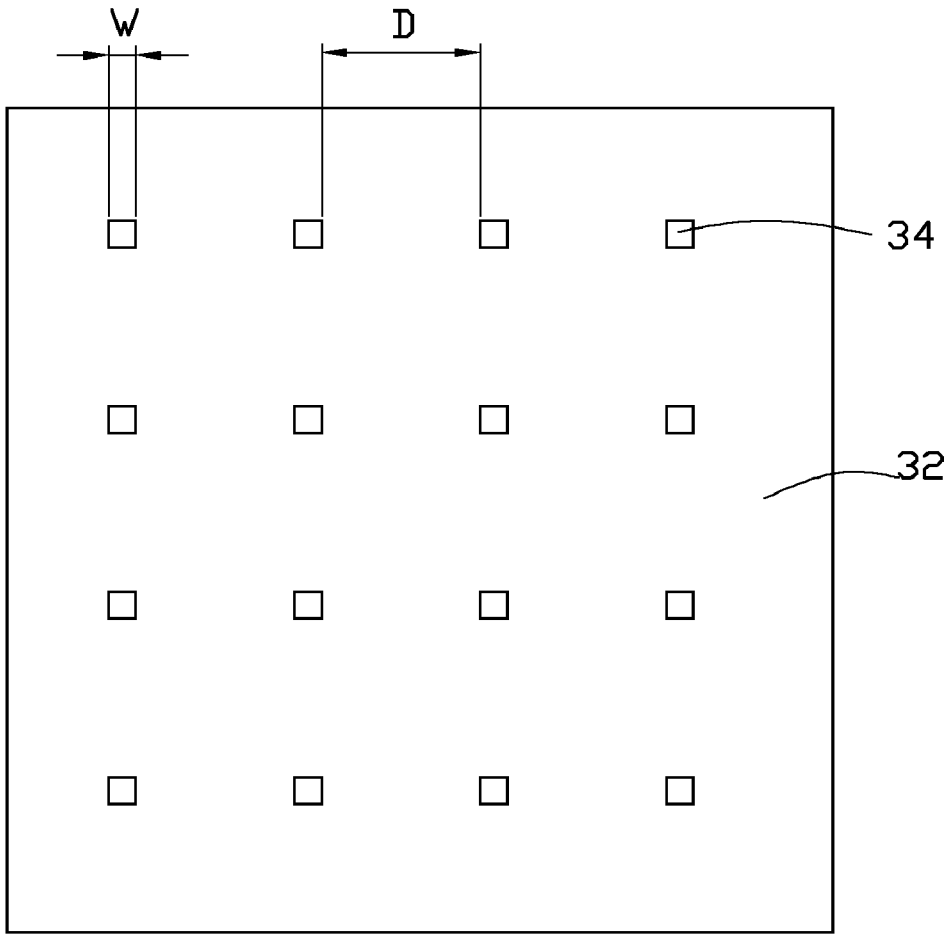
FIG. 2 is a top view of a light emitting module of the LED lamp of FIG. 1.
Figure 3:
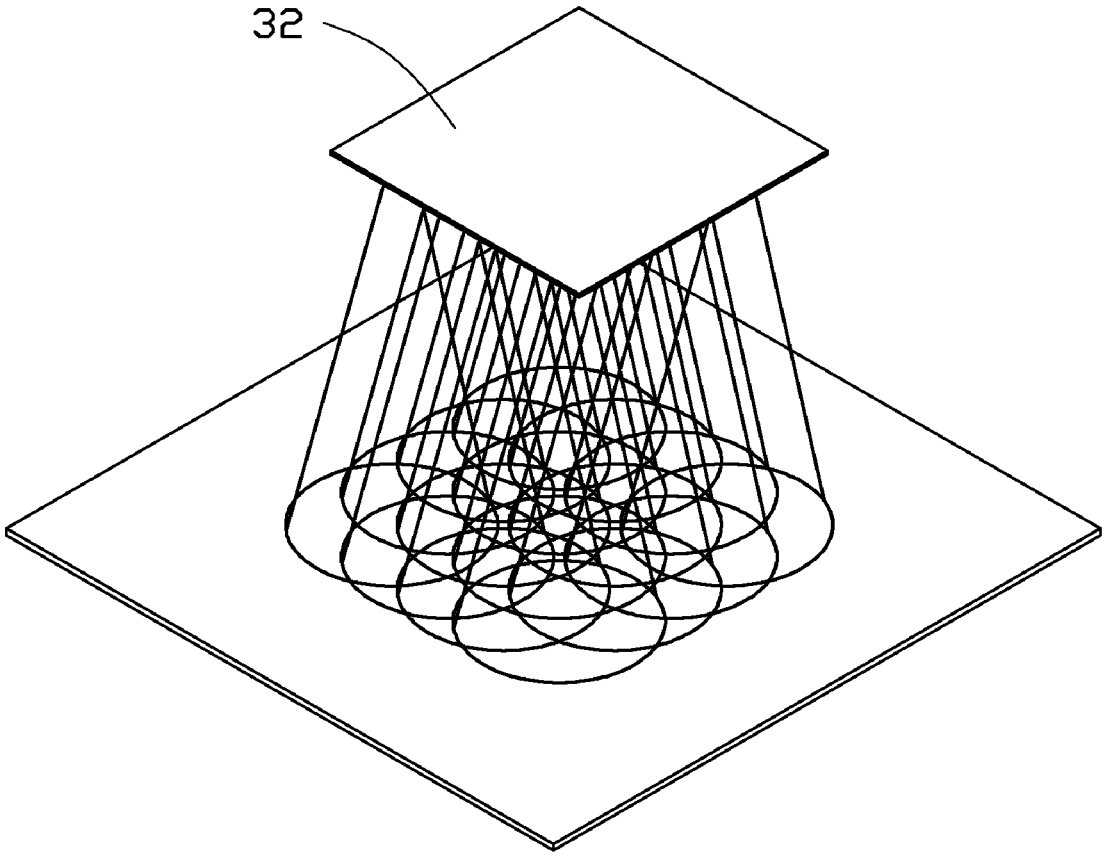
FIG. 3 is a schematic view showing an illumination area of the LED lamp of FIG. 1 on an object.

Referring to FIGS. 2-3, the light emitting module 30 comprises a printed circuit board 32 and a plurality of LEDs 34 attached to the printed circuit board 32. The printed circuit board 32 is attached to the upper side of the base 22 of the heat sink 20. The LEDs 34 are arranged in a square array. Each of the LEDs 34 has a square shape with a width W. Each of the LEDs 34 spaces from an adjoining LED 34 with a distance D. When the LED lamp 100 works, light beams emitted by each of the LEDs 34 form an illuminating area on a light-receiving object. When the width W and the distance D are in the condition that $W/D>0.15$, the light beam of each LED 34 having a periphery portion overlaps with those of light beams of adjoining LEDs 34 on the light-receiving object, thereby avoiding to produce dark regions on the light-receiving object. In this embodiment, the LED lamp 100 is an indoor lamp and the light emitting module 30 distances from the light-receiving object for about 2 to 5 meters. When the width W and the distance D are in the condition that $W/D<0.5$, the light emitting efficiency is preferable. More preferable, the width W and the distance D can be further in the condition that $W/D<0.20$. For example, the each LED's width W is 4.8 mm and the distance D is 28.5 mm; therefore, the width W and the distance D meet the condition that $0.2>W/D>0.15$.

It is to be understood, however, that even though numerous characteristics and advantages of certain embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A light emitting diode (LED) lamp comprising:

a lamp rack comprising an inner wall and a frame extending integrally upwards and downwards from outer edges of the inner wall, the inner wall having an opening defined in a center thereof, the inner wall forming two spaced, confronting concave supporting portions at two spaced, confronting sides of the opening;

a heat sink mounted on the lamp rack, the heat sink having a bottom portion thereof extending through the opening of the inner wall and having a top portion with two opposite ends, the opposite ends of the top portion being embedded in the concave supporting portions and abutted against the inner wall; and a light emitting module mounted on the top portion of the heat sink, the light emitting module comprising:

a printed circuit board; and a plurality of LEDs attached to the printed circuit board, the LEDs being arranged in an array, each of the LEDs having a width W, each of the LEDs spacing from an adjoining LED with a distance D, the width W and the distance D being in a condition that 0.5>W/D>0.15.

2. The LED lamp of claim 1, wherein the width W and the distance D is in a condition that 0.2>W/D>0.15.

3. The LED lamp of claim 2, wherein the width W of each LED is 4.8 millimeter, and the distance D is 28.5 millimeter.

4. The LED lamp of claim 1, wherein each of the LEDs has a square shape, and the distance D of each two adjoining LEDs is the same as each other.

5. The LED lamp of claim 1, wherein the top portion of the heat sink is parallel to the inner wall of the lamp rack.

* * * * *